US006273732B1

(12) United States Patent
Johnescu et al.

(10) Patent No.: US 6,273,732 B1
(45) **Date of Patent: *Aug. 14, 2001**

(54) THROUGH MOUNT CONNECTOR WITH ALIGNMENT DEVICE

(75) Inventors: Douglas M. Johnescu, York; Simon C. Cowley, Mechanicsburg, both of PA (US)

(73) Assignee: BERG Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/336,000

(22) Filed: Jun. 18, 1999

(51) Int. Cl.[7] ..... H01R 12/00
(52) U.S. Cl. ..... 439/79
(58) Field of Search ..... 439/79, 80

(56) References Cited

U.S. PATENT DOCUMENTS

| | | | | |
|---|---|---|---|---|
| Re. 35,735 | | 2/1998 | Douty et al. | 439/571 |
| 5,078,626 | | 1/1992 | Matsuoka et al. | 439/892 |
| 5,184,963 | | 2/1993 | Ishikawa | 439/79 |
| 5,382,168 | * | 1/1995 | Azuma et al. | 439/79 |
| 5,399,105 | | 3/1995 | Kaufman et al. | 439/609 |
| 5,409,384 | | 4/1995 | Green et al. | 439/67 |
| 5,591,036 | | 1/1997 | Doi et al. | 439/79 |
| 5,658,156 | | 8/1997 | Henderson et al. | 439/79 |
| 5,676,554 | * | 10/1997 | Tsuji | 439/79 |
| 5,688,130 | | 11/1997 | Huang | 439/79 |
| 5,692,912 | * | 12/1997 | Nelson et al. | 439/79 |
| 5,709,556 | | 1/1998 | Tan et al. | 439/79 |
| 5,775,923 | | 7/1998 | Tomioka | 439/79 |
| 5,879,171 | * | 3/1999 | Wu | 439/79 |

FOREIGN PATENT DOCUMENTS

| | | |
|---|---|---|
| 0702432A1 | 3/1996 | (EP) . |
| WO9621256 | 7/1996 | (WO) . |

* cited by examiner

*Primary Examiner*—Tulsidas Patel
(74) *Attorney, Agent, or Firm*—Woodcock Washburn Kurtz Mackiewicz & Norris LLP

(57) ABSTRACT

A through mount electrical connector with an alignment device is disclosed. According to the invention, the connector is mountable to a substrate and includes a housing through which a plurality of contacts extend. Each contact has a contact tail that extends beyond a face of the housing. The connector includes an alignment device having a first face adjacent the housing, a second face positionable adjacent the substrate, and a plurality of apertures extending between the first face and the second face for receiving a respective contact tail. At least one latch slidably couples the alignment device to ends of the housing such that the alignment device is selectively disposable between a first position in which the contact tails generally do not extend beyond the second face of the alignment device, and a second position in which the contact tails generally extend beyond the second face of the alignment device.

11 Claims, 6 Drawing Sheets

THROUGH MOUNT CONNECTOR WITH ALIGNMENT DEVICE

FIELD OF THE INVENTION

This invention relates to electrical connectors. More particularly, the invention relates to apparatus and methods for connecting a through mount electrical connector to a printed circuit board.

BACKGROUND OF THE INVENTION

It is known in the art that through mount connectors having contacts with fine tail pitch have been prone to bending or stubbing during insertion of the connector into a printed circuit board (PCB). This problem can be overcome by properly aligning the contact tails with the corresponding PCB holes before insertion so that they do not stub during insertion. Another problem is damage caused by handling prior to PCB insertion. This problem can be overcome by protecting the contacts during shipping and handling.

Additionally, some through mount connectors include rivets or screws that are used to attach the connector to the PCB before soldering. These connectors are known to be difficult to manufacture. To address this concern, connectors with fasteners such as interference hold-downs have been introduced to eliminate the need for screws or rivets. It is known that approximately 6–30 pounds of force is needed to press this type of connector into the PCB. With this type of connector, alignment of the contact tails with the corresponding receiving holes is important because this amount of force does not allow for tactile feed back of the contacts either entering or not entering the PCB holes. Thus, any contact tail that is not properly aligned with the corresponding hole, can be bent or even destroyed when force is applied to press the connector hold-downs into the PCB. Significantly, the user is typically unaware that any of the contact tails have been damaged until after the connector has been seated on the board.

To reduce the incidence of contact tail bending, alignment devices have been used with both vertical and right angle through mount connectors to hold the contact tails in alignment with the corresponding PCB holes before the connector is pressed onto the PCB. The alignment devices known in the art, however, are typically inside the connector housing, with the contact tails extending away from the alignment device. As the mounting ends of the contact tails extend farther away from the alignment device, they can be, and often are, farther out of alignment due to larger angular displacement and spring back. In addition, a longer cantilevered beam is less rigid than a shorter cantilevered beam and is more prone to misalignment.

Thus, there is a need in the art for an alignment device for a through mount connector that improves the alignment of the contact tails with the corresponding PCB holes by preventing the contact tails from extending away from the alignment device before insertion, thereby reducing the incidence of contact tail bending during insertion.

SUMMARY OF THE INVENTION

The above described needs in the art are satisfied by a through mount electrical connector having an alignment device according to the present invention. The connector of the invention is mountable to a substrate, such as a printed circuit board, and comprises a housing, a plurality of contacts, an alignment device, and at least one latch. Each of the contacts has a contact tail that extends through the housing and beyond the face thereof.

The alignment device has a first face adjacent the housing, a second face positionable adjacent the substrate, and a plurality of apertures extending between the first face and the second face for receiving a respective contact tail. The latch slidably couples the alignment device to ends of the shell such that the alignment device is selectively disposable between a first position in which the contact tails generally do not extend beyond the second face of the alignment device, and a second position in which the contact tails generally extend beyond the second face of the alignment device.

In another aspect of the invention, the alignment device comprises a contact receiving portion having a plurality of contact receiving apertures extending therethrough. The alignment device includes at least one latch located generally at each end thereof. The latches form a connector receiving area therebetween, and are adapted to slidably couple the alignment device to the shell, such that the alignment device can be selectively disposed in either a first position in which mounting ends of the contacts are disposed generally within the contact receiving apertures, or in a second position in which the contacts extend through the contact receiving apertures.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed.

DETAILED DESCRIPTION OF PREFERRED EMBODIMENT

Figure 1A:
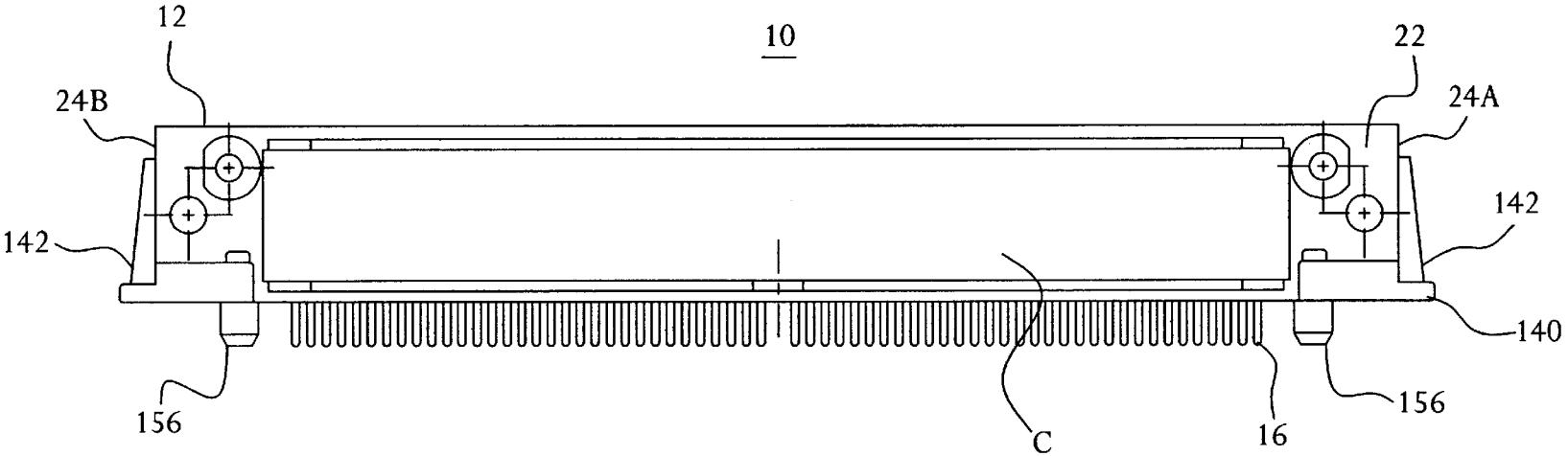
FIGS. 1A and 1B are front and rear views, respectively, of a preferred embodiment of a connector according to the present invention.
Figure 1B:
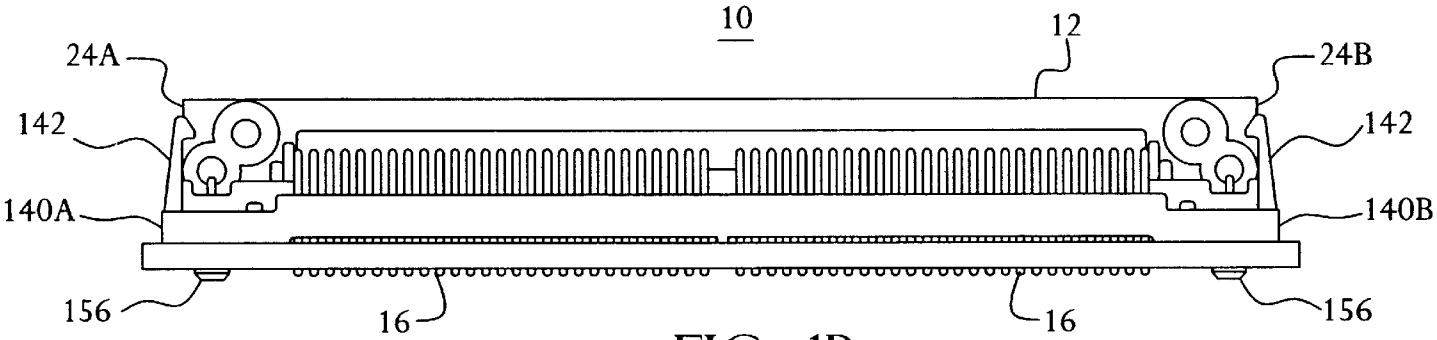

FIGS. 1A and 1B are front and rear views, respectively, of a preferred embodiment of a connector 10 according to the present invention. Connector 10 is shown as a right angle connector such as a Micropax™ receptacle part number 90787 available from FCI/Berg. It should be understood, however, that a connector according to the present invention can be any type of through hole mounted connector, such as a vertical through mount connector, for example. Connector 10 comprises an elongated shell 12, an elongated tail alignment device 140, a plurality of contacts 16, and a dielectric material 13 separating shell 12 and contacts 16. Shell 12 and dielectric material 13 together form a connector housing.

Connector shell 12 has a first end 24A, and a second end 24B opposite first end 24A. Preferably, shell 12 can be die cast from a suitable material, such as zinc, and dielectric material 13 can be glass-filled LCP, for example. Alignment device 140 is slidably coupled to shell 12 via a pair of latches 142 and includes a pair of PCB alignment posts 156. Note that, as shown in FIGS. 1A and 1B, alignment device 140 can have a lateral width that is greater than the lateral width of shell 12. That is, the distance from end 140B to end 140B of alignment device 140 can be greater than the distance from end 24A to end 24B of connector shell 12.

Figure 3B:
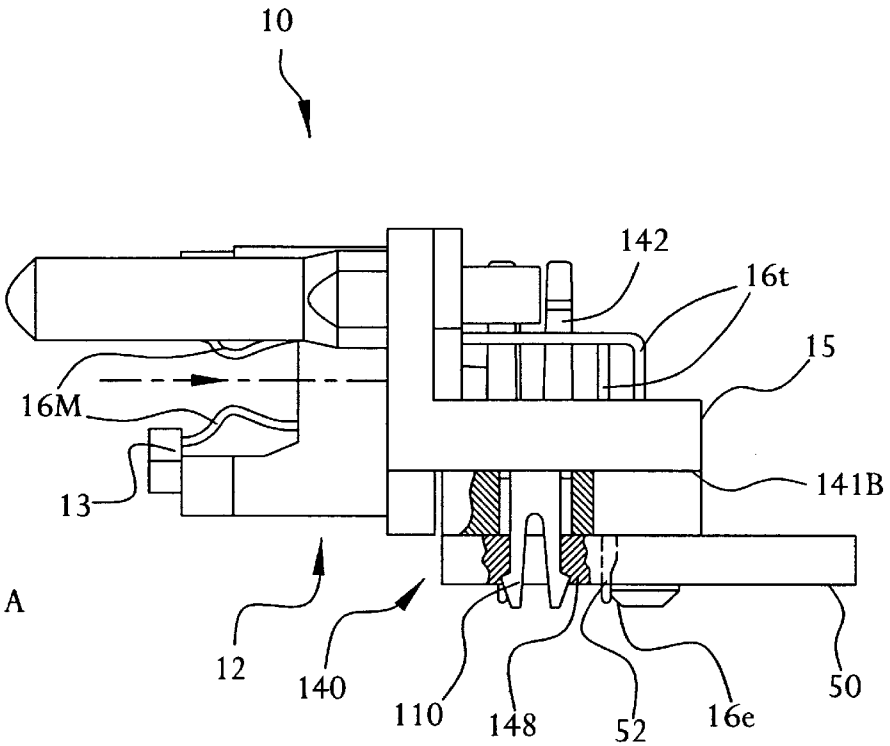
FIGS. 3B and 4B are side and rear views of a connector according to the present invention after insertion into a printed circuit board.
Figure 3A:
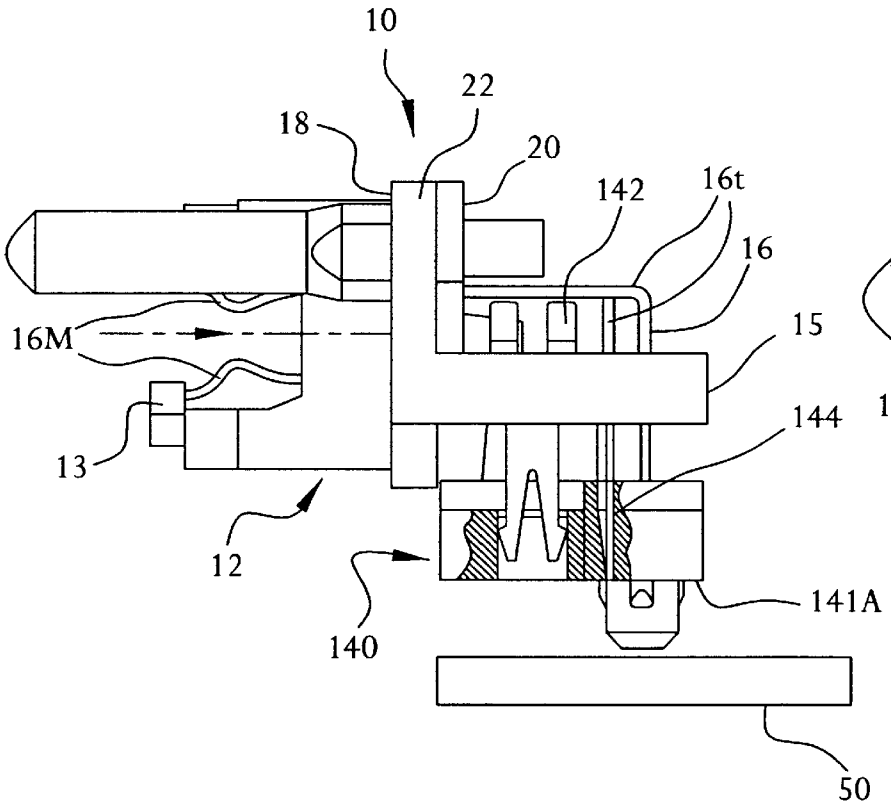
FIGS. 3A and 4A are side and rear views of a connector according to the present invention before insertion into a printed circuit board.

FIG. 1A shows connector 10 having a protective cap C inserted into shell 12. Cap C shelters contacts 16 from damage during handling and shipment. FIGS. 3A and 3B show connector 10 without protective cap C.

Figure 2A:
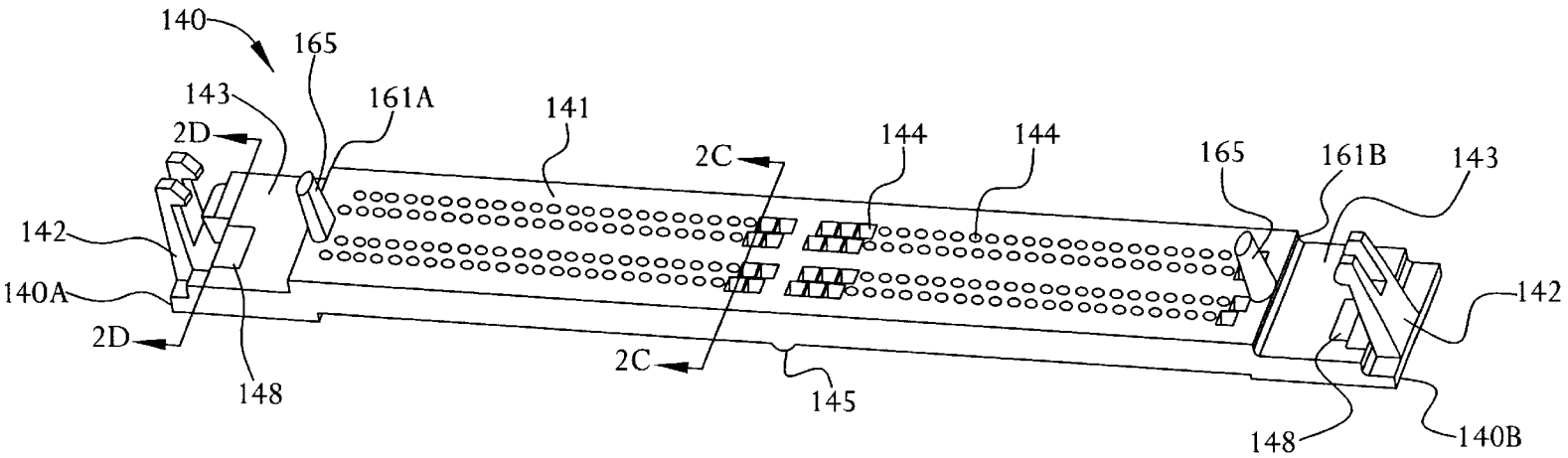
FIGS. 2A and 2B are isometric and side views, respectively, of a preferred embodiment of an alignment device according to the present invention.
Figure 2B:
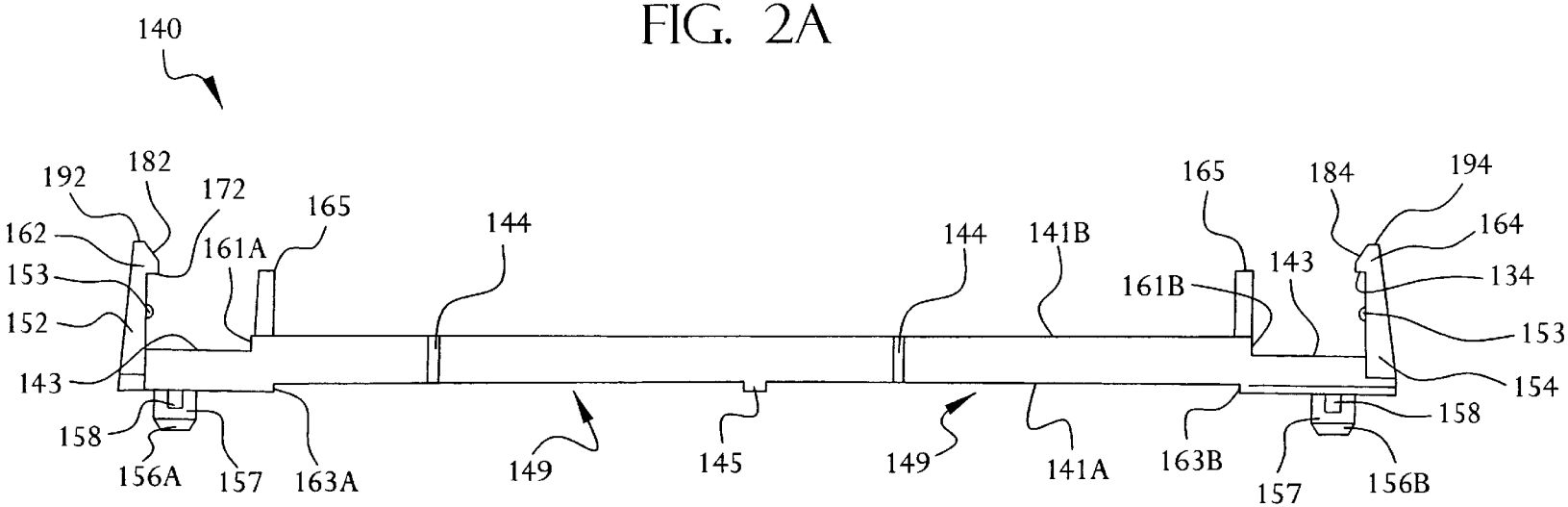

FIGS. 2A and 2B are isometric and side views, respectively, of a preferred embodiment of an alignment device 140 according to the present invention. Preferably, alignment device 140 has a first end 140A, a second end 140B opposite first end 140A, and comprises an elongated contact receiving portion 141. Contact receiving portion 141 has a top face 141B adjacent shell 12 having a first end 161A and a second end 161B, and a bottom face 141A opposite top face 141B having a first end 163A and a second end 163B. A plurality of tail alignment apertures 144 extend between top face 141B and bottom face 141A.

The pattern of tail alignment apertures 144 shown in FIGS. 2A and 2B is exemplary only and the invention is in no way limited to any particular pattern. It should be understood, however, that the pattern of alignment apertures 144 on alignment device 140 should match the pattern of contact tails emanating from the connector, as well as the pattern of contact tail receiving through holes on the PCB. Of course, alignment device 140 could have more tail alignment apertures 144 than the connector has contacts without adversely affecting its performance.

Figure 2D:
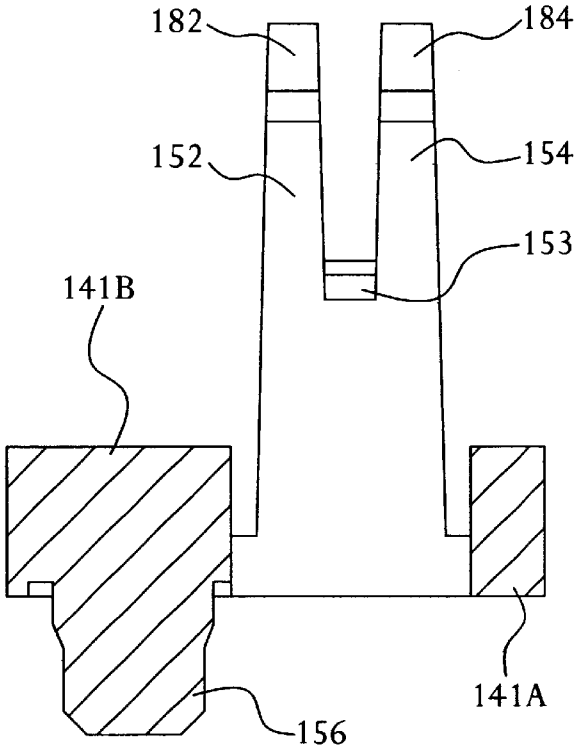
FIGS. 2C and 2D are detailed cross-sectional views of a preferred embodiment of an alignment device according to the present invention.
Figure 2C:
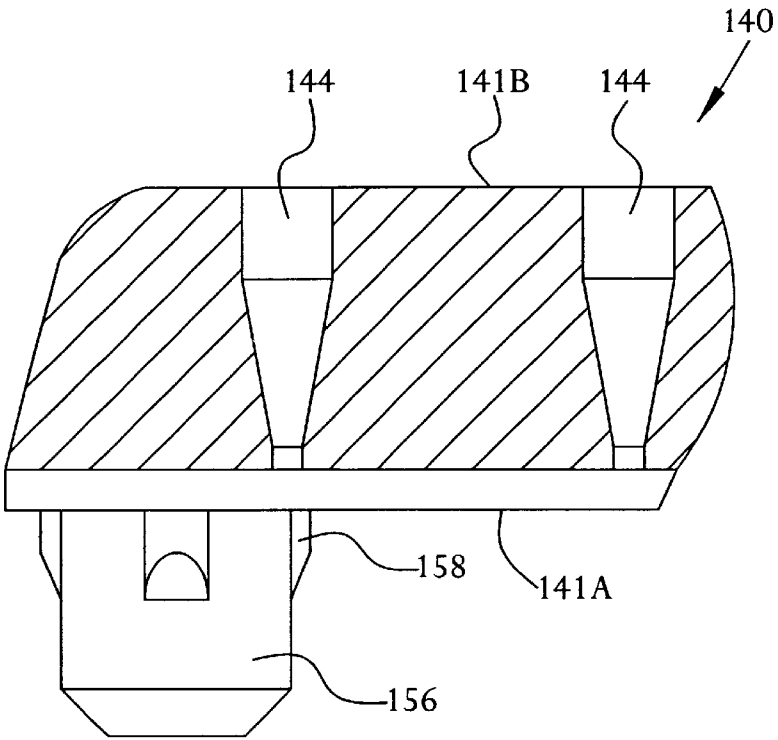

A cross-section of a typical tail alignment aperture 144 is shown in FIG. 2C. Preferably, each tail alignment aperture 144 has a substantially conical or pyramidal shaped lead-in surface. This shape helps alignment device 140 receive misaligned contacts and reduces the risk that the contact tails will be bent while being inserted into the tail alignment apertures by guiding or funneling the contact tails into the tail alignment apertures. Preferably, each tail alignment aperture 144 is about 0.040×0.040 inches at top face 141B, and about 0.011×0.011 inches at bottom face 141A. Note that, although the alignment device depicted in FIG. 2A shows only some tail alignment apertures 144 having this conical or pyramidal shape, most or all tail alignment apertures 144 in a preferred embodiment of the present invention will have this shape.

Alignment device 140 also has at least one and preferably two PCB alignment posts 156 that extend away from wings 143 and are integrally formed therewith. Alignment device 140 can be made, for example, from a high temperature plastic such as LCP. Each PCB alignment post 156 has a plurality of ribs 158 disposed around its perimeter. Ribs 158 ensure that when connector 10 is inserted into a PCB, PCB alignment posts 156 either fit snugly into the receiving hole, or slightly interfere with little force required to press alignment device 140 onto the PCB. Preferably, ribs 158 are much shorter than PCB alignment posts 156 so that PCB alignment posts 156 will insert easily into the PCB before getting tight in the receiving holes. Ribs 158 also provide an economical and efficient way to alter the diameter of PCB alignment posts 156. By varying the distance ribs 158 extend from alignment post core 157, the effective diameter of PCB alignment post 156 can be varied as well. In this way, only the width of ribs 158 needs to be varied, rather than alignment post core 157. FIG. 2B shows that one post, 156B, has four ribs 158 (so post 156B acts as a reference point), while the other post, 156A, has two ribs 158.

As shown in FIGS. 2A and 2B, alignment device 140 has at least one and preferably two shell alignment guides 165 extending towards shell 12 from top face 141B. Preferably, each shell alignment guide 165 is semi-circular in cross-section and, as will be described in greater detail below, facilitates the mating of alignment device 140 with shell 12 when connector 10 is inserted onto the PCB.

Alignment device 140 also has a pair of hold down apertures 148, each of which extends through a wing 143 of alignment device 140. As will be described in greater detail below, hold down apertures 148 receive hold down fasteners (see FIGS. 5A–E) when connector 10 is inserted onto the PCB.

Alignment device 140 further comprises at least one and preferably two latches 142 that slidably couple alignment device 140 to shell 12. Each latch 142 is preferably connected to alignment device 140 near an end 140A, 140B thereof. Preferably, each latch 142 has three tines 152, 153, 154, although it can have more or less than three. As best seen in FIG. 2D, it is preferred that tines 152 and 154 are located at the distal ends of a pair of arms that have about the same length, while tine 153 is situated between the proximal ends of the arm. Each tine 152–154 has a tine head 162–164 having a substantially flat face 172–174 and a sloped face 182–184. Preferably, each sloped face 182–184 slopes at an angle of about 30° relative to flat face 172–174. Each tine 152–154 also has a generally flat distal end 192–194, the purpose of which will be described below.

Tines 152 and 154 are preferably larger than tine 153. The larger size of the tines helps to retain alignment device 140 on shell 12. The smaller size of tine 153 helps control the insertion force of connector 10 onto the PCB.

It is known that when contacts are soldered onto a PCB, unwanted, excess solder flux is frequently deposited near the connection between the contacts and the PCB. To provide a mechanism for efficient removal of this unwanted solder flux, alignment device 140 can also include a strip 145 extending from the front of alignment device 140 to the rear thereof. Preferably, strip 145 extends from bottom face 141A and is located nearly halfway between ends 163A, 163B. Strip 145 extends about as far from bottom face 141A as do wings 143. As shown, a pair of grooves 149 are formed between strip 145 and ends 163A, 163B. Grooves 149 cause gaps to be formed between bottom face 141A of alignment device 140 and the surface of the substrate onto which connector 10 is mounted (see FIG. 4B). Excess solder flux can then be flushed away from between alignment device 140 and the substrate through grooves 149.

Figure 4B:
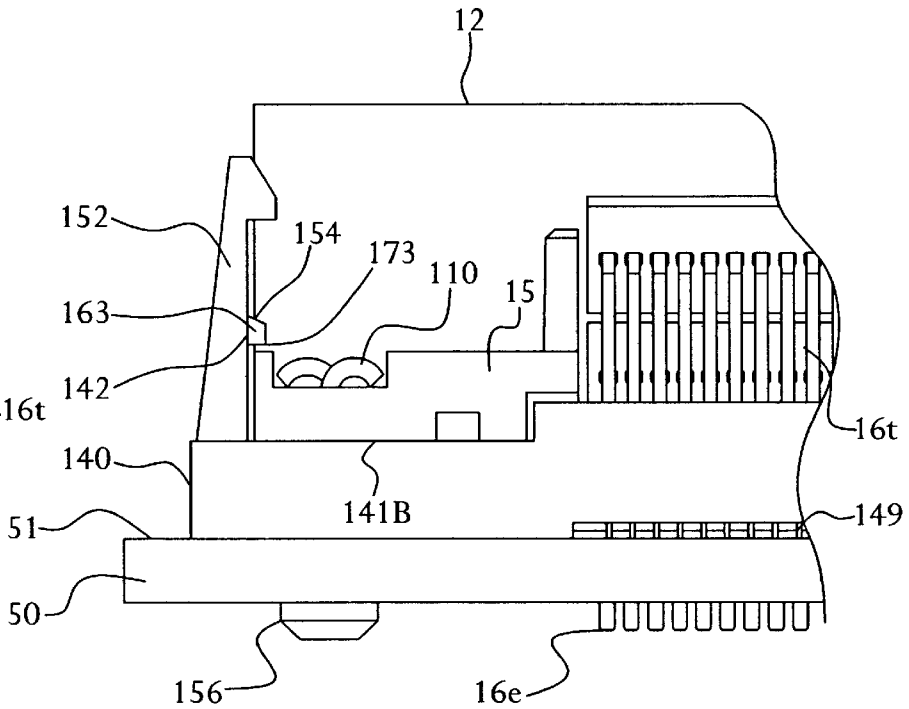
Figure 4A:
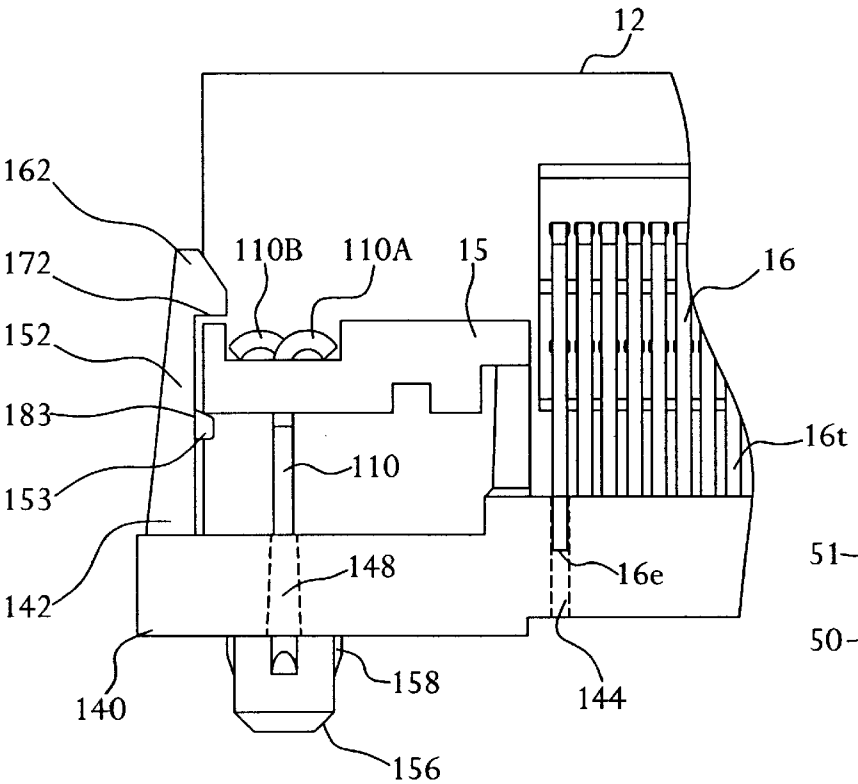

FIGS. 3A and 4A are side and rear views of connector 10 before insertion into a printed circuit board (PCB) 50. As best seen in FIG. 3A, flange 22 of connector shell 12 has a front face 18 and a rear face 20, each of which extends generally between opposite ends 24A, 24B (see FIG. 1A) of connector shell 12. Contacts 16 extend through flange 22 such that each contact 16 includes a mating portion 16*m* that extends from front face 18, and a tail portion 16*t* that extends from rear face 20. Connector 10 is shown as a right-angle connector and, therefore, tail portions 16*t* of contacts 16 are basically L-shaped, although the invention is not so limited. Preferably, tail portions 16*t* are adapted for solder connection to appropriate circuit traces (not shown) on circuit board 50 or in appropriate contact receiving holes 52 in circuit board 50. When a mating connector (not shown) is inserted into connector 10, complementary contacts on the mating connector engage contact portions 16*m* of contacts 16.

Each contact tail 16*t* is received, at least partially, into a corresponding tail alignment aperture 144 of alignment device 140, thus reducing the likelihood that contact tails 16*t* will be bent during shipment of connector 10 and before or during insertion onto PCB 50. Ideally, contact tails 16*t* are received into alignment apertures 144 such that mounting ends 16*e* are flush with or above bottom face 141A of alignment device 140. As seen in FIG. 1B, shell 12 resides on alignment device 140 between latches 142.

To keep mounting ends 16*e* of contact tails 16*t* as nearly flush with bottom face 141A as possible, latches 142 trap flange 15 of shell 12 between tines 152, 154 and tine 153 (see FIG. 4A). More specifically, flange 15 rests between end 183 of tine 153 and flat face 172 of tine head 162. Flat face 172 prevents alignment device 140 from sliding along contact tails 16*t* away from flange 15, while flat end 183 of tine head 163 prevents alignment device 140 from sliding along contact tails 16*t* toward flange 22. Thus, latch 142 enables alignment device 140 to provide optimum alignment by ensuring that alignment device 140 stays positioned such that mounting ends 16*e* of contact tails 16*t* stay within contact receiving apertures 144. In this way, the connector of the present invention does not require a user to manually position alignment device 140 relative to mounting ends 16*e* of contact tails 16*t*. It should be understood that, where tine 153 is smaller than tine 152, the deflection of tine 152 induces significantly more deflection in tine 153 than tine 153 would have alone.

Note that hold down fastener 110 has a pair of flaps 110A, 110B. During manufacture, hold down fastener 110 is press fit into flange 15 and is received at least partially into hold down aperture 148 of alignment device 140. Flaps 110A, 110B are then bent over or flared out onto flange 15 to ensure that hold down fastener 110 does not slide through flange 15.

Figure 5A:
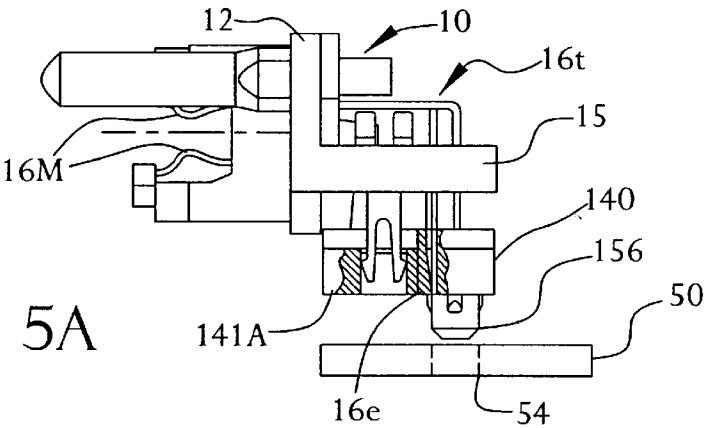
FIGS. 5A–5E are cross-sectional views of a connector according to the present invention depicting a method of connecting a through mount connector to a printed circuit board.
Figure 5B:
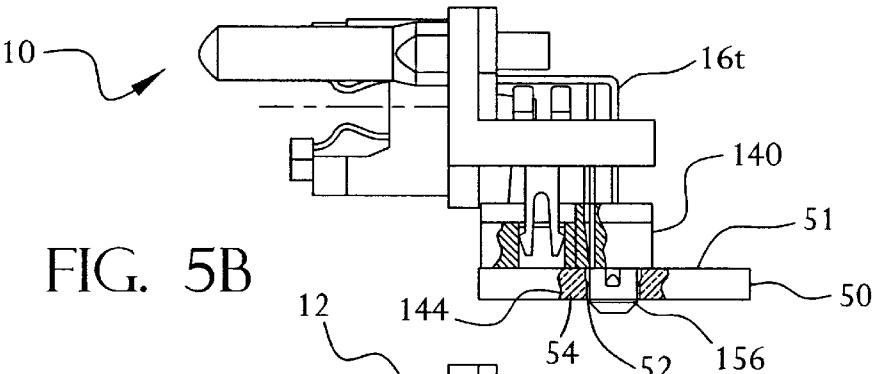
Figure 5C:
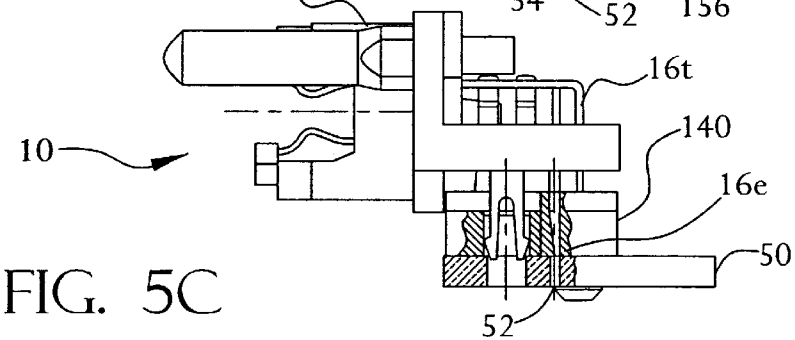
Figure 5D:
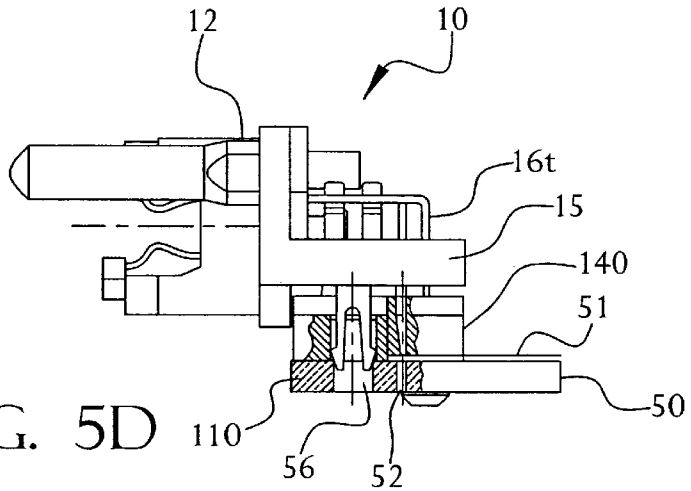
Figure 5E:
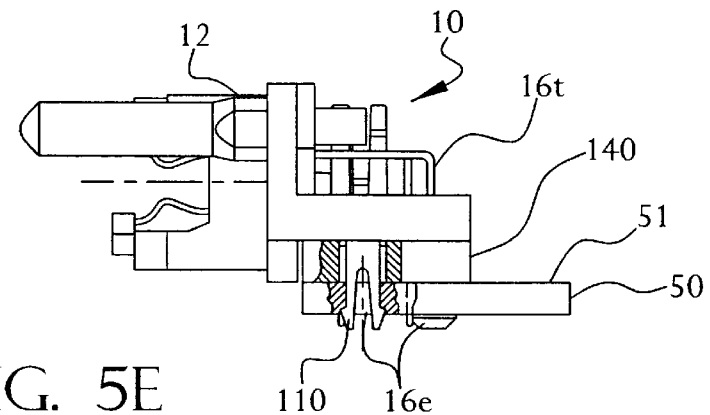

FIGS. 5A–5E depict a preferred embodiment of a method according to the present invention for connecting a through mount connector 10 to a printed circuit board 50. As shown in FIG. 5A, alignment device 140 is located at a first position away from shell 12 such that mounting ends 16*e* of contact tails 16*t* are either flush with or above bottom face 141A. PCB alignment posts 156 are aligned with the corresponding post receiving holes 54 on PCB 50 and then, as shown in FIG. 5B, connector 10 is pressed toward PCB 50 until PCB alignment posts 156 are fully inserted into post receiving holes 54. Alignment device 140 is then seated firmly against the surface 51 of PCB 50. At this point, tail receiving apertures 144 are aligned as closely as possible with the corresponding contact receiving holes 52 on PCB 50. Next, as shown in FIG. 5C, shell 12 is moved toward PCB 50. This movement will deflect the smaller tines 153 of latches 142 as flange 15 passes along sloped faces 183 of tine heads 163, and mounting ends 16*e* of contact tails 16*t* will begin to move into contact receiving holes 52 on PCB 50. As shell 12 continues moving toward PCB 50, as shown in FIG. 5D, hold down fasteners 110 begin to press into hold down receiving holes 56 on PCB 50. Shell 12 is pressed until flange 15 is flush against top face 141B of alignment device 140, and alignment device 140 reaches a second position at which bottom face 141A is flush with surface 51 of PCB 50 (FIG. 5E). At this point, connector 10 has been completely seated on PCB 50, and alignment device 140 is secured between shell 12 and PCB 50. Contacts 16 and, if required for grounding, hold down fasteners 110, can then be soldered to PCB 50 using known techniques.

It can be seen from FIG. 5E, that the height of connector 10 (i. e., the distance from surface 51 of PCB 50 to the top of connector 10) is proportional to the thickness of alignment device 140. By varying the thickness of alignment device 140, therefore, the height of connector 10 can be varied as well. Accordingly, the thickness of alignment device 140 can be adjusted to accommodate any desired connector height.

FIGS. 3B and 4B are cross-sectional views of connector 10 after insertion into PCB 50. As shown, top face 141B of alignment device 140 is flush against flange 15, hold down fasteners 110 extend through hold down apertures 148, and contact tails 16*t* extend beyond alignment device 140 so that mating ends 16*e* can be soldered onto or into PCB 50. In this way, alignment device 140 also functions as a spacer between shell 12 and PCB 50. A spacer, such as alignment device 140, prevents shell 12 from sitting below surface 51 of PCB 50 when connector 10 is inserted therein. This is an advantage of the present invention because, if shell 12 were to sit below surface 51, the process of soldering connector 10 to PCB 50 could cause solder flux to be deposited on shell 12. It should be understood that this would be undesirable for a number of electrical performance reasons.

Referring to FIG. 4B, note that flat face 173 of tine head 163 now prevents flange 15 from sliding away from alignment device 140 when at the second position. Thus, latches 142 ensure that shell 12 will stay in place when mounted into PCB 50. That is, flange 15 will remain flush against top face 141B of alignment device 140.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

We claim:

1. An electrical connector mountable to a substrate, the substrate having a hold down receiving hole and a plurality of contact receiving holes, the connector comprising:

a housing having a first end, a second end, and a face;

a plurality of contacts extending through the housing, each of which has a contact tail that extends beyond the face;

an alignment device having a first face adjacent the housing, a second face positionable adjacent the substrate, and a plurality of apertures extending between the first face and the second face for receiving a respective contact tail;

a hold down fastener that extends from the face of the housing at least partially into a receiving aperture of the alignment device; and a pair of latches that slidably couple the alignment device to the ends of the housing such that the alignment device is selectively disposable along a length of the contact tails between a first position in which the latches hold the alignment device such that distal ends of the contact tails generally extend between the first face of the alignment device and the second face of the alignment device, and a second position in which the latches hold the alignment device such that the contact tails generally extend beyond the second face of the alignment device, such that when the connector is mounted to the substrate, the contact tails enter the contact receiving holes before the hold down fastener engages the hold down receiving hole.

2. The connector of claim 1, wherein each of the latches comprises a first tine and a second tine, each of which is adapted to permit movement of the alignment device in a first direction and to restrict movement of the alignment device in a second direction opposite the first direction.

3. The connector of claim 2, wherein the first and second tines retain the housing therebetween in the first position.

4. The connector of claim 1, wherein the housing resides on the alignment device in the second position.

5. The connector of claim 4, wherein the alignment device has a lateral width greater than a lateral width of the housing.

6. The connector of claim 1, further comprising a shell alignment guide on the alignment device and a corresponding opening in the housing to receive the shell alignment guide.

7. The connector of claim 1, further comprising at least one alignment post for mounting the alignment device to the substrate.

8. An alignment device for an electrical connector having a housing and a plurality of contacts, comprising:

a contact receiving portion elongated between a first end and a second end thereof, and having a first face, a second face, and plurality of contact receiving apertures extending between the faces;

at least one latch located generally at each end of the alignment device, the latches forming a connector receiving area therebetween, wherein the latches are adapted to slidably couple the alignment device to the housing such that the alignment device can be selectively disposed in either a first position in which mounting ends of the contacts are disposed generally within the contact receiving apertures, or in a second position in which the contacts extend through the contact receiving apertures; and at least one shell alignment guide disposed generally between the latches and extending from the first face of the contact receiving portion, the shell alignment guide adapted to be received into a corresponding opening in the housing and thereby to guide the connector into engagement with the alignment device.

9. The alignment device of claim 8, wherein the at least one latch is adapted for outward deflection upon engagement with the connector.

10. The alignment device of claim 8, wherein the at least one latch comprises a first tine and a second tine, each of which is adapted to permit movement of the alignment device in a first direction and to restrict movement of the alignment device in a second direction opposite the first direction.

11. The alignment device of claim 8, further comprising at least one alignment post extending from the second face of the contact receiving portion for mounting the alignment device to a circuit substrate.

* * * * *